United States Patent [19]

Saito

[11] Patent Number: 4,923,484

[45] Date of Patent: May 8, 1990

[54] METHOD AND APPARATUS FOR TREATING EXHAUST GAS FOR REMOVAL OF FINE PARTICLES

[75] Inventor: Keizo Saito, Tsuchiura, Japan

[73] Assignee: Agency of Industrial Science & Technology, Ministry of International Trade & Industry, Tokyo, Japan

[21] Appl. No.: 319,723

[22] Filed: Mar. 7, 1989

[30] Foreign Application Priority Data

Mar. 11, 1988 [JP] Japan ..... 63-58708

[51] Int. Cl.[5] ..... B01D 39/20; F01N 3/02

[52] U.S. Cl. ..... 55/21; 55/96; 55/97; 55/212; 55/267; 55/283; 55/523; 55/DIG. 10; 55/DIG. 30; 60/311

[58] Field of Search ..... 55/96, 97, 208, 267, 55/283, 523, DIG. 10, DIG. 30, 21, 212; 60/274, 298, 303, 311

[56] References Cited

U.S. PATENT DOCUMENTS

| | | | |
|---|---|---|---|
| 3,056,662 | 10/1962 | Ridgway | 55/DIG. 30 |
| 3,870,474 | 3/1975 | Houston | 55/DIG. 30 |
| 4,054,417 | 10/1977 | Rosebrock | 55/DIG. 30 |
| 4,281,512 | 8/1981 | Mills | 55/DIG. 30 |
| 4,329,162 | 5/1982 | Pitcher, Jr. | 55/DIG. 30 |
| 4,345,431 | 8/1982 | Suzuki et al. | 55/DIG. 30 |
| 4,373,330 | 2/1983 | Stark | 55/DIG. 30 |
| 4,386,497 | 6/1983 | Takagi et al. | 55/DIG. 30 |
| 4,404,795 | 9/1983 | Oishi et al. | 55/DIG. 30 |
| 4,404,798 | 9/1983 | Takagi et al. | 55/DIG. 30 |
| 4,427,418 | 1/1984 | Kogiso et al. | 55/DIG. 30 |
| 4,481,767 | 11/1984 | Stark | 55/DIG. 30 |
| 4,485,622 | 12/1984 | Takagi et al. | 55/DIG. 30 |
| 4,573,317 | 3/1986 | Ludecke | 55/DIG. 30 |
| 4,597,262 | 7/1986 | Retallick | 55/DIG. 30 |
| 4,672,809 | 6/1987 | Cornelison et al. | 55/DIG. 30 |
| 4,674,278 | 6/1987 | Rognon | 55/DIG. 30 |
| 4,730,455 | 3/1988 | Pischinger et al. | 55/DIG. 30 |

FOREIGN PATENT DOCUMENTS

| | | | |
|---|---|---|---|
| 59-063316 | 4/1984 | Japan | 55/DIG. 10 |
| 61-146315 | 7/1986 | Japan | 55/283 |
| 2083372 | 3/1982 | United Kingdom | 55/283 |
| 2097283 | 11/1982 | United Kingdom | 55/DIG. 30 |

*Primary Examiner*—Robert Spitzer

*Attorney, Agent, or Firm*—Oblon, Spivak, McClelland, Maier & Neustadt

[57] ABSTRACT

Fine particles including volatile components and combustible non-volatile components are removed from exhaust gas by a method comprising providing at least two paths for the gas each with a filter capable of trapping the particles and conducting a process of trapping the particles and a process of burning the trapped particles separately and alternately in different filters with an apparatus including at least two fine particle trapping apparatus each constituted as a pipe-like structure having its one end connected with a pipe for untreated exhaust gas, its other end connected with a pipe for treated exhaust gas and a filter made of incombustible material and capable of trapping the particles disposed between the two ends, switchover valves for selectively opening and closing the two ends, and heaters for heating the filters to a prescribed temperature.

5 Claims, 4 Drawing Sheets

METHOD AND APPARATUS FOR TREATING EXHAUST GAS FOR REMOVAL OF FINE PARTICLES

BACKGROUND OF THE INVENTION

1. Field of the Invention

This invention relates to a method and apparatus for treating exhaust gas for removal of fine particles, more particularly to such a method and apparatus capable of highly effective removal of non-volatile dry soot as well as of soluble organic fractions (SOF) apt to escape upon volatilization.

2. Prior Art Statement

The fine particles of noxious substances contained in the exhaust gas from diesel engines, gas turbines, stirling engines and the like are polluting the environment.

Conventional techniques for reducing the fine-particle content of exhaust gas center on methods for improving combustion and methods for treatment of the exhaust gas after it has been produced. This invention falls in the latter category.

One such method for treating exhaust gas after it has been produced involves the use of a filter trap. A filter trap made of ceramic or the like is installed downstream of the exhaust manifold and the fine particles are trapped as the exhaust gas passes therethrough. When the quantity of the trapped particles reaches such a level as to cause the engine exhaust pressure to fall below a predetermined level, the filter is heated so as to burn the trapped fine particles and regenerate the filter. This process is repeated intermittently.

In order to burn off the trapped fine particles at the time of filter regeneration, it is necessary to establish the required combustion conditions within a short period of time. Specifically, an appropriate oxygen concentration and temperature for commencement of combustion must be quickly established. Conventionally, therefore, the filter has been installed immediately downstream of the exhaust manifold and the exterior of the filter has been heat insulated so as to take advantage of the heat of the exhaust gas and thus make it possible to achieve the required temperature increase rapidly and to minimize energy consumption.

In the conventional system it is therefore necessary to carry out fine particle trapping at a relatively high temperature, with the result that the temperature frequently rises above the volatilization temperature of the soluble organic: fractions (SOF) contained in the fine particles. As a result, most of the SOF has been exhausted in the form of gas, making it impossible to trap it in the filter.

Moreover, exhaust gas continues to pass through the filter even during the regeneration process. Thus even in the case where fine particles including SOF components are trapped, those SOF components which volatilize before the temperature for burning the fine particles is reached are exhausted together with the gas passing through the filter.

This inability to remove SOF components has seriously detracted from the effectiveness of the conventional exhaust gas treatment methods and apparatus as regards their ability to reduce the emission of noxious fine particles.

While it is possible to employ a metallic-system catalyst in order to carry out the filter generation at a relatively low temperature, i.e. for lowering the fine particle combustion temperature, this has the adverse effect of increasing the emission of sulfates.

OBJECT AND SUMMARY OF THE INVENTION

The object of this invention is to provide a method and an apparatus for treating exhaust gas for the removal of fine particles which is able to prevent the emission of SOF components contained in the fine particles in the exhaust gas while suppressing increase in the emission of sulfates.

For realizing the aforesaid object, the present invention provides a method and apparatus wherein a plurality of paths for passage of an exhaust gas comprising volatile fine particle components and non-volatile fine particle components are provided, a filter capable of trapping the fine particles is provided in each of the paths, and the process of trapping the fine particles and the process of burning the trapped fine particles are conducted separately and alternately in different filters.

With this method for treating exhaust gas for removal of fine particles, since two or more treatment paths are established, it is possible to conduct the trapping of fine particles in one filter while the burning of trapped fine particles is being conducted in another filter. This makes it possible to maintain the filter in the open path being used for trapping fine particles at a temperature lower than that at which the SOF components volatilize (about 200° C.) and thus to trap all of the fine particles in the filter without fear of the SOF components contained in the fine particles volatilizing and passing to the exterior in gaseous form.

On the other hand, the outlet of the path in which regeneration is being carried out is kept closed at least while the temperature of the filter being regenerated is being increased from the volatilization temperature of the trapped SOF to the temperature at which both the dry soot and the SOF begin to burn (about 500–600 C.). The volatilized SOF components are thus prevented from escaping to the exterior and are held in the path until they are ignited at the time the dry soot begins to burn. After burning of the SOF components has begun, both ends of the path are opened so as to introduce exhaust gas rich in residual oxygen into the filter under regeneration and maintain the oxygen concentration at an appropriate level while the combustion is in progress.

As a result, both the dry soot components and the SOF components can be removed by burning without risk of either being passed to the exterior in either the particle trapping process or the filter regeneration process.

The above and other features of the present invention will become apparent from the following description made with reference to the drawings.

BRIEF DESCRIPTION OF THE DRAWINGS

FIG. 1(*b*) is an explanatory view relating to the same embodiment showing the filter of one treatment path being heated and the filter of the other treatment path beginning the process of fine particle trapping.

FIG. 1(*c*) is an explanatory view of the same embodiment showing the fine particle trapped in the filter of one treatment path being burned while the trapping of fine particles continues in the filter of the other treatment path.

FIG. 1(*d*) is an explanatory view of the same embodiment showing the filter of one treatment path being cooled while the trapping of fine particles continues in the filter of the other treatment path.

DETAILED DESCRIPTION OF THE PREFERRED EMBODIMENT

Figure 1A:
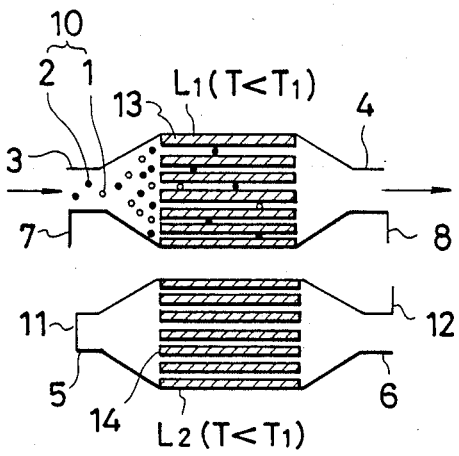
FIG. 1(*a*) is an explanatory view of an embodiment of the method for treating exhaust gas for removal of fine particles according to this invention showing fine particles being trapped by the filter of one of two treatment paths.
Figure 1B:
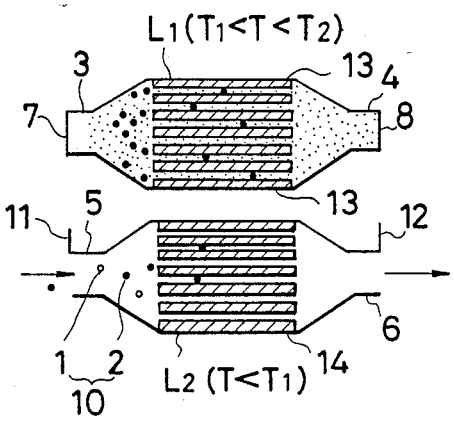
Figure 1C:
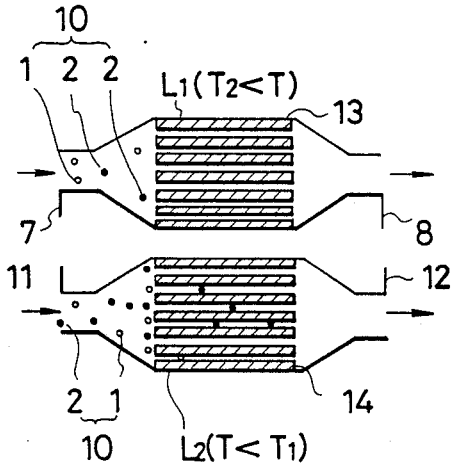
Figure 1D:
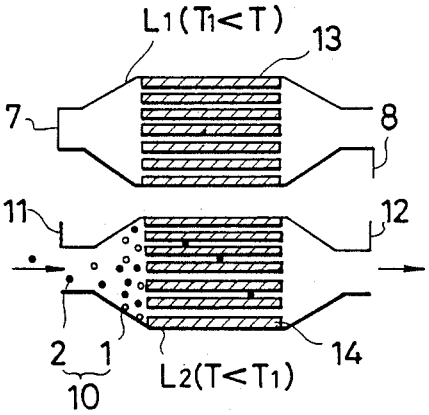

In the embodiment of the method for removing fine particles from exhaust gas according to the present invention shown in FIG. 1, two exhaust gas treatment paths $L_1$ and $L_2$ are provided in parallel. The opposite ends 3, 4 of the path L are provided with valves 7, 8, respectively, and between the ends 3, 4 is provided a filter 13 capable of trapping volatile particle components (SOF) and non-volatile particle components from exhaust gas. The corresponding portions of the path $L_2$, which is of the same construction, are the opposite ends 5, 6, the valves 11, 12 and the filter 14. The filters 13 and 14 are made of an incombustible material. In FIG. 1, the volatile components are designated by reference numeral 1 and the non-volatile components by reference numeral 2. So as to facilitate understanding, these two types of components are illustrated as being separate from each other. In actual fact, however, the fine particles 10 are individually composites of volatile and non-volatile components.

First, with the valves 7,8 at the opposite ends 3, 4 of the filter 13 in the open state, exhaust gas is continuously supplied from the end 3 so as to conduct a fine particle trapping process in which the fine particles 10 contained in the exhaust gas are trapped by the filter 13. While this fine particle trapping process is in progress, the temperature of the filter 13 is maintained lower than the temperature $T_1$ (about 200° C.) at which the volatile components volatilize, and at the same time the valve 11 at the end 5 on the inlet side of the path $L_2$ is kept closed. This makes it possible to prevent the SOF components from escaping without being trapped and increases the fine particle removal efficiency. (FIG. 1(*a*))

After a prescribed amount of fine particles have been trapped in the filter 13, the valves 11, 12 at the ends 5, 6 of the path $L_2$ are opened and the fine particle trapping process is switched over to the path $L_2$. Concurrently, regeneration is carried out in path $L_1$. More specifically, the valves 7, 8 at the ends 3, 4 are both closed and the filter 13 is heated to the temperature at which the non-volatile components 2 burn (temperature $T_2$). What is important here is that if the valves 7, 8 at the ends 3, 4 are maintained closed at least during the period that the temperature T of the filter 13 satisfies the relationship $T_1<T<T_2$, the volatile components 1 which are volatilized into gaseous form at temperature $T_1$ can be prevented from escaping to the exterior of the path $L_1$, thus enhancing the efficiency with which the volatile components can be removed.

When the filter 13 reaches the temperature $T_2$, the non-volatile components 2 begin to burn causing ignition of the now gaseous volatile components 1, which also start to burn. Once the volatile components 1 have started to burn, the valves 7, 8 at the ends 3, 4 of the path $L_1$ are partially opened to allow a controlled quantity of oxygencontaining exhaust gas to flow through the path $L_1$, in this way enabling the burning of the trapped fine particles 10 to continue under conditions of a controlled flow of oxygen. Since the trapping of fine particles is continued in the path $L_2$ during this period (FIG. 1(*c*)), the effect of the exhaust treatment can be enhanced.

When the burning of the trapped fine particles is completed in the path $L_1$, the valve 7 at the end 3 is closed and the heater switch is turned off. At the same time, a cooling fluid (e.g. air) is passed over the outer surface of the path $L_1$ so as to lower the temperature of the filter 13. During this period the fine particle trapping process is continued in path $L_2$ (FIG. 1(*d*)).

The lowering of the temperature of the filter 13 to below $T_1$ completes the regeneration process and readies the filter 13 for conducting the fine particle trapping process. The situation then becomes the same as shown in FIG. 1(*a*) except that the roles of the paths $L_1$ and $L_2$ are interchanged. Then immediately that the fine particle trapping process is completed in path $L_2$ and this path is switched over to the regeneration process, the path $L_1$ again commences fine particle trapping.

Figure 2:
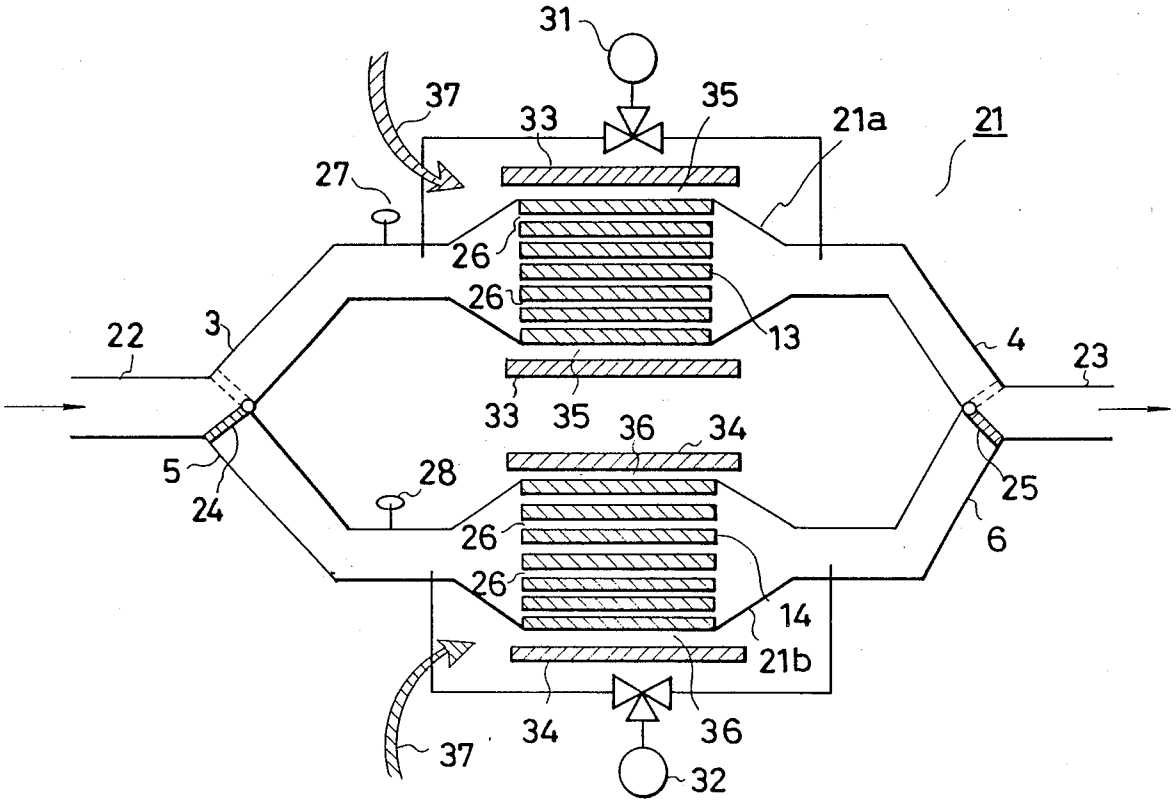
FIG. 2 is a schematic sectional view of one embodiment of the apparatus for treating exhaust gas for the removal of fine particles according to this invention.

FIG. 2 is a schematic representation of one embodiment of the apparatus for treating exhaust gas for removal of fine particle according to this invention. The apparatus, which is designated by the reference numeral 21, comprises two fine particle trapping apparatus 21*a*, 21*b*, each of which is of pipe-like structure and connected at one end 3 or 5 to an exhaust pipe 22 for passage of untreated exhaust gas and the other end of which 4 or 6 is connected to an exhaust pipe 23 for passage of treated exhaust gas. At an intermediate portion of each particle trapping apparatus 21*a* or 21*b* is disposed a filter 13 or 14 made of incombustible material and capable of trapping fine particles 10.

Figure 3:
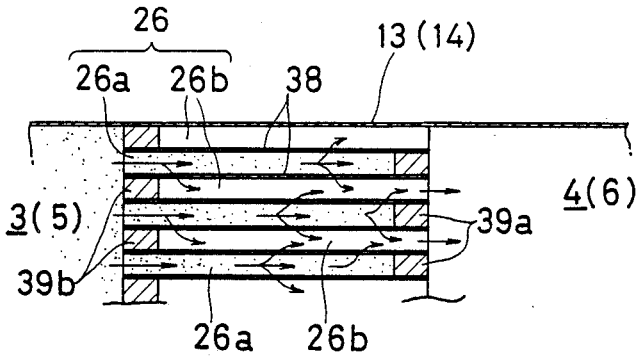
FIG. 3 is a cross sectional view illustrating one example of a filter usable in the apparatus for treating exhaust gas for removal of fine particles according to the present invention.

One example of the filter 13 (14) is illustrated in FIG. 3. It is cylindrical and has a plurality of pores 26 serving as axial flow paths. The flow paths 26*a* open to the side 3 (5) of the inlet for the exhaust gas are stopped up on the side 4 (6) of the outlet for the exhaust gas by ceramic plugs 39*a*, and the flow paths 26*b* open to the outlet side 4 (6) are stopped up on the inlet side 3 (5) by ceramic plugs 39*b*. The flow paths 26*a* and 26*b* are alternately superposed via ceramic porous members 38 having a pore diameter on the μm order. Cordierite is advantageously used as a material for the ceramic plugs 39*a*, 39*b* and for the ceramic porous members 38.

Switchover valves 24, 25 are provided at the opposite ends of the fine particle trapping apparatus 21*a* or 21*b*, at the points where they are connected with the exhaust pipes 22, 23. By switching of the switchover valves 24, 25 it is possible to communicate the exhaust pipe 22 with either the end 3 of the fine particle trapping apparatus 21*a* or the end 5 of the fine particle trapping apparatus 21*b*, and to communicate the exhaust pipe 23 with either the end 4 of the fine particle trapping apparatus 21*a* or the end 6 of the fine particle trapping apparatus 21*b*.

Between the switchover valve 24 and the filters 13, 14 are respectively provided flow rate regulation valves 27, 28 for enabling the exhaust gas flow rate to be regulated as required.

Cylindrical electrical heaters 33, 34 are provided on the exteriors of the fine particle trapping apparatus 21*a*, 21*b* so as to be coaxial with these apparatus. The heaters 33, 34 serve to heat the filters 13, 14 to the temperature $T_2$ at which the non-volatile dry soot components of the exhaust gas begin to burn.

Gaps 35, 36 for the passage of air or other cooling fluid 37 are respectively formed between the fine particle trapping apparatus 21*a* and the heater 33 and between the fine particle trapping apparatus 21*b* and the heater 34.

The fine particle trapping apparatus 21*a*, 21*b* are respectively provided with differential pressure gages 31, 32 for detecting pressure difference between the upstream and down stream ends of the filters 13, 14. From the values of the differential pressures detected by the differential pressure gages 31, 32 it is possible to determine the start and completion times of particle trapping and regeneration in the filters 13, 14, and this information is used for controlling the switchover valves 24, 25 so as to alternate the particle trapping and regeneration processes between the two filters.

The operation of the apparatus 21 for treating exhaust gas for removal of fine particles will now be explained. First, for trapping fine particles, the switch of the heater of one of the two fine particle trapping apparatus, say the apparatus 21*a*, is turned off and air or some other cooling fluid 37 is passed by an appropriate means to flow through the gap 35 so as to cool the filter 13 to below the temperature $T_1$ at which the volatile SOF components volatilize. When this temperature has been reached, the opposite ends 3, 4 are opened to permit entry of untreated exhaust gas from the exhaust pipe 22. As a result, fine particles including SOF components are trapped by the filter 13.

At this time, regeneration of the filter 14 is begun in the other fine particle trapping apparatus 21*b*(which for simplicity of explanation is presumed to have just completed a fine particle trapping operation). This regeneration process is initiated by a signal from the differential pressure gage 32 which causes supply of cooling fluid 37 to be discontinued and the switch of the heater 34 to be turned on. The temperature of the filter 14 thus rises. At this time the switchover valve 25 is maintained in the position for keeping the outlet at the end 6 closed at least during the period that the filter 14 is being heated from the temperature $T_1$ to the temperature $T_2$. As a result, the SOF components that gasify are held within the fine particle trapping apparatus 21*b* until they can be burned after the filter has been heated to temperature $T_2$ and the dry soot components begin to burn. When this stage is reached, the valves 24, 25 are operated to open the opposite ends 5, 6 of the fine particle trapping apparatus 21*b* so as to allow residual oxygen in the exhaust gas to enter the apparatus 21*b* and support continued combustion of the dry soot and SOF components of the fine particles until they are completely burned and the filter 14 is regenerated. The SOF components are thus removed by burning and do not escape to the exterior.

Figure 4:
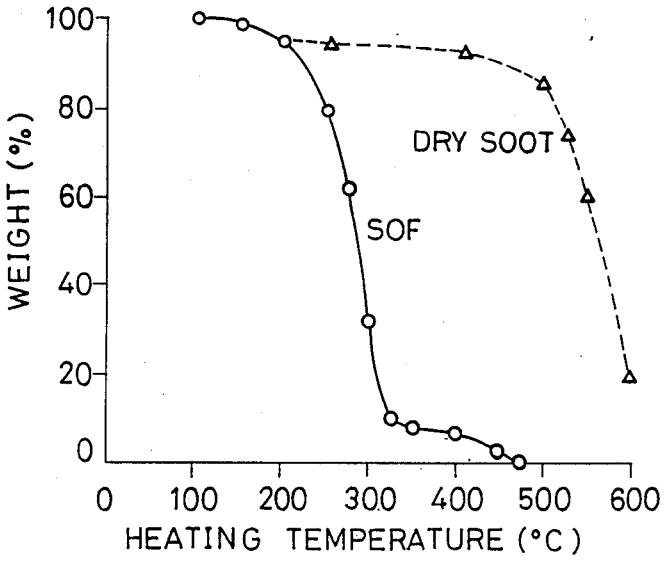
FIG. 4 is a graph illustrating the relation between the heating temperature and the weight reduction of SOF and dry soot in exhaust gas.

FIG. 4 shows the state of reduction in weight of fine particles of SOF and dry soot contained in exhaust gas from a small-sized diesel engine when the fine particles are heated. When the heating temperature exceeded 100° C., the fine particles were volatilized to gradually reduce their weight. When the heating temperature was elevated to about 300° C., SOF volatilized and dry soot remained. When the heating temperature was further elevated to 600° C., dry soot was burnt and consequently the weight of the fine particles was pronouncedly reduced. This will be understood from the graph of FIG. 4.

Figure 5:
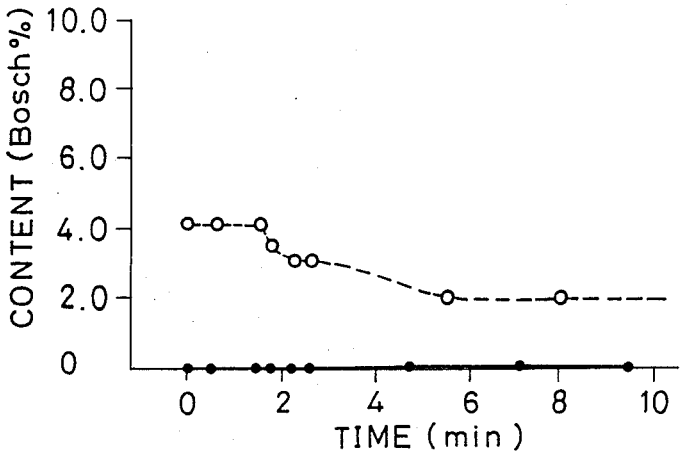
FIG. 5 is a graph illustrating the content of fine particles in exhaust gas measured with a Bosch meter before and after being passed through the filter.

FIG. 5 shows results of the measurement of fine particles in exhaust gas from a diesel engine of a small-sized truck by the use of a Bosch meter sensitive to dry soot and incapable of detecting SOF. The content of 3 to 4% of dry soot (shown by blank circles o) in the exhaust gas not passed through the filter was reduced to substantially 0% (shown by solid circles •) after being passed through the filter. It seemed as if the fine particles in the exhaust gas had been all trapped by the filter.

Figure 6:
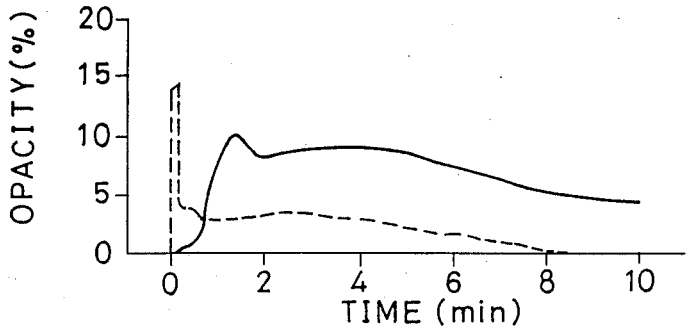
FIG. 6 is a graph illustrating the opacity of the exhaust gas measured with an opacity meter before and after being passed through the filter.

In order to confirm this, a measurement was made by the use of an opacity meter sensitive to both dry soot and SOF. The results are as shown in FIG. 6. The degree of opacity of the exhaust gas was very large at the moment the engine was started and thereafter became smaller and smaller (shown by the dotted line). However, the degree of opacity of the exhaust gas after being passed through the filter (shown by the solid line) was larger than that of the exhaust gas before being passed through the filter. This means that SOF trapped by the filter was passed through and discharged out of the filter by the heating treatment.

In view of the measurement results mentioned above, the present invention employs a plurality of filters which alternately operate in particle trapping and regeneration modes. This makes it possible to conduct fine particle trapping at a low temperature at which the SOF components do not volatilize and, by using heaters, to burn the SOF components trapped by the filters at a high temperature, with the valves at the opposite ends being kept closed to ensure that the SOF components do not escape to the exterior before the temperature at which they begin to burn is reached. The method and apparatus according to this invention are thus able to remove noxious fine particles from exhaust gas with excellent effectiveness and efficiency.

Moreover, since there is no need to use a catalyst, they also have the effect of suppressing emission of sulfates.

What is claimed is:

1. A method for treating exhaust gas for removal of fine particles including volatile components and combustible non-volatile components, which comprises the steps of:

disposing in parallel a pair of first and second paths for the passage of the exhaust gas, each of said first and second paths having an inlet end and an outlet end, and inserting therein between the inlet and the outlet end of each of said first and second paths, a filter capable of trapping the fine particles;

providing a first switchover valve movable between a first position at which the inlet end of the first path is completely opened and the inlet end of the second path is completely closed and a second position at which the inlet end of the first path is completely closed and the inlet end of the second path is completely open, and a second switchover valve movable between another first position at which the outlet end of the first path is completely open and the outlet end of the second path is completely closed and another second position at which the outlet end of the first path is completely closed and the outlet end of the second path is completely open;

introducing the exhaust gas into the first path, with the inlet end and outlet end thereof completely open and the inlet end and outlet end of the second path completely closed with said first and second switchover valves and with a temperature of the filter of the first path set lower than a volatilization temperature of the volatile components, thereby allowing the fine particles to be trapped by the filter of the first path;

completely closing the inlet end and outlet end of the first path when a prescribed amount of fine particles have been trapped by the filter of the first path, and raising the temperature of the filter of the first path to a combustion temperature of the combustible non-volatile components and, at the same time, introducing the exhaust gas into the second path, with the inlet end and outlet end thereof completely open with said first and second switchover valves and with a temperature of the filter of the second path set lower than the volatilization temperature of the volatile components, thereby allowing the fine particles to be trapped by the filter of the second path;

partially opening the inlet end of the first path and completely opening the outlet end of the first path when the temperature of the filter of the first path has reached the combustion temperature of the combustible non-volatile components, thereby combusting the fine particles trapped by the filter of the first path;

completely closing the inlet end of the first path when the fine particles trapped by the filter of the first path have been completely combusted, and cooling the filter of the first path to a temperature lower than the volatilization temperature of the volatile components;

completely closing the inlet end and outlet end of the second path when a prescribed amount of fine particles have been trapped by the filter of the second path, and raising the temperature of the filter of the second path to the combustion temperature of the combustible non-volatile components and, at the same time, introducing the waste gas into the first path, with the inlet end and outlet end of the first path completely open, when the filter of the first path has been cooled to the temperature lower than the volatilization temperature of the volatile components;

partially opening the inlet end of the second path and completely opening the outlet end of the second path when the temperature of the filter of the second path has reached the combustion temperature of the combustible non-volatile components, thereby combusting the fine particles trapped by the filter of the second path; and completely closing the inlet end of the second path when the fine particles trapped by the filter of the second path have been completely combusted, and cooling the filter of the second path to a temperature lower than the non-volatilization temperature of the volatile components.

2. A method according to claim 1, wherein the volatilization temperature of the volatile components is not less than 200° C. and the combustion temperature of the combustible non-volatile components is not less than 600° C.

3. A method according to claim 1, wherein said prescribed amount of fine particles trapped by each of said filters in said first and second paths is detected from the difference in pressure between the upstream and downstream ends of said filters.

4. An apparatus for treating exhaust gas for removal of fine particles including volatile components and combustible non-volatile components, which comprises:

a pair of first and second paths for the passage of the exhaust gas disposed in parallel, each of said first and second paths having an inlet end and an outlet end;

a pair of first and second filters capable of trapping the fine particles and inserted in said first and second paths, respectively, between the inlet end and the outlet end;

a first switchover valve disposed at the inlet ends of said first and second paths for selectively opening and closing the inlet ends;

a second switchover valve disposed at the outlet ends of said first and second paths for selectively opening and closing the outlet ends;

heater means for heating said first and second filters to a combustion temperature of the combustible non-volatile components; and cooler means for cooling said first and second filters to a temperature lower than a volatilization temperature of the volatile components;

said first filter in said first path being cooled to a temperature lower than the volatilization temperature of the volatile components by said cooler means to allow the fine particles to be trapped thereon, with the inlet end and outlet end of said first path completely open for introducing the waste gas into said first path, while said second filter in said second path having the fine particles trapped therein is heated to the combustion temperature of the combustible components by said heater means, with the inlet end and outlet end of said second path completely closed;

the inlet end of said second path being partially opened and the outlet end of said second path being completely opened when said second filter has been held at the combustion temperature, thereby combusting the fine particles trapped by said second filter;

said second filter being cooled to a temperature lower than the volatilization temperature of the volatile components by said cooler means when the combustion has terminated, with the inlet end of said second path completely closed;

the inlet end and outlet end of said first path being completely closed when said first filter has trapped a prescribed amount of fine particles, thereby heating said first filter to the combustion temperature by said heater means.

5. An apparatus according to claim 4 further comprising differential pressure gages for detecting difference in pressure between the upstream and downstream ends of said filters to control said switchover valves.

* * * * *